United States Patent [19]

Weber et al.

[11] 4,437,652

[45] Mar. 20, 1984

[54] VESSEL FOR THE TREATMENT OF MOLTEN METAL

[75] Inventors: Richard A. Weber, Moers; Carl-Heinz Schütz, Duisburg, both of Fed. Rep. of Germany

[73] Assignee: Thyssen Aktiengesellschaft Vorm.August Thyssen-Hutte, Duisburg, Fed. Rep. of Germany

[21] Appl. No.: 401,207

[22] Filed: Jul. 23, 1982

[30] Foreign Application Priority Data

Jul. 27, 1981 [EP] European Pat. Off. ..... 81 105 911.2

[51] Int. Cl.[3] ..... C21C 7/10; C22B 9/04

[52] U.S. Cl. ..... 266/275; 266/208; 266/210

[58] Field of Search ..... 75/49; 266/275, 210, 266/208

[56] References Cited

U.S. PATENT DOCUMENTS 3,027,150 3/1962 Harders ..... 75/49
3,136,834 6/1964 Lorenz ..... 75/49
3,547,622 12/1970 Hutchinson ..... 266/210

FOREIGN PATENT DOCUMENTS 848192 9/1960 United Kingdom ..... 266/210

*Primary Examiner*—L. Dewayne Rutledge
*Assistant Examiner*—S. Kastler
*Attorney, Agent, or Firm*—Sprung, Horn, Kramer & Woods

[57] ABSTRACT

The invention relates to a vessel for the continuous treatment of molten metals under reduced pressure, according to the circulation process. In order to increase the through put of the molten metal, the inlet and outlet pipes are located on the longitudinal axis of an elongated vessel-bottom, for example an elliptical vessel-bottom, a cross-section of the inlet and outlet pipes being enlarged. The lower portion of the vessel is bell-shaped. With this geometry of the lower portion of the vessel, the volume of the vessel remains small, despite comparatively large cross-sections of the inlet and outlet pipes, which can be located with an adequate clearance from each other and the walls of the vessel, so that the danger of erosion effects resulting from the circulating molten metal remains small.

4 Claims, 3 Drawing Figures

(I-I)

(II-II)

VESSEL FOR THE TREATMENT OF MOLTEN METAL

BACKGROUND OF THE INVENTION

The invention relates to a vessel for the continuous treatment of molten metals under reduced pressure, according to the circulation process, especially for continuous degassing steel melts, this vessel being provided in its bottom, with an inlet pipe which dips into the molten metal, and an outlet pipe for the molten metal which has been treated, this outlet pipe being located so that it is spatially separated from the inlet pipe and, in particular, dipping into the molten metal.

Vessels of this type are employed, in particular, in the degassing of liquid steel according to the socalled "circulation process" (Ruhrstahl-Heraeus-process). In this process, the liquid steel, contained in a ladle which is positioned beneath the vessel, is lifted into the vessel by introducing conveying gas into the inlet pipe, and by applying suction to the vessel, and flows, in a continuous stream, through the outlet pipe of the vessel, and back into the ladle. In this process, the length of time for which the steel is treated is given by its circulation rate, which depends, in its turn, on the diameter of the vessel and on the cross-sections of the inlet and outlet pipes (German Offenlegungsschrift No. 1 458 874 U.S. Pat. No. 31 36 834).

Having regard to achieving as high a production rate as possible, and to avoiding heat losses during the treatment of liquid steel, the steelmaker endeavors to minimize the duration of the treatment to which the steel is subjected.

In the past, attempts have already been made to increase the circulation rate of the liquid steel by increasing the cross-sections of the inlet pipe and/or the outlet pipe of the vessel. However, for a given diameter of the vessel-bottom, the inlet pipe and/or the outlet pipe can be enlarged only by a limited amount. Since the flowing steel subjects the refractory lining of the vessel to an extremely powerful erosion effect, the inlet and outlet pipes require to be located, in the vessel-bottom, with an adequately large clearance, both with respect to each other, and in the directions of the vessel walls, in order to ensure that the refractory lining has a sufficiently long service life.

If, accordingly it is desired, on the grounds of metallurgical or economic considerations, to shorten the time for which the steel is treated, it was always necessary, in the past, to employ a degassing vessel with correspondingly increased dimensions.

The use of a suitably larger vessel not only requires the deployment of additional amounts of capital, but it is often absolutely impossible, for space-related reasons, to install a larger vessel in a plant which is already in existence.

SUMMARY OF THE INVENTION

The object of the present invention is to provide a vessel for the treatment of liquid metal, of the type initially mentioned, by means of which it is possible to obtain a markedly higher rate of circulation of the liquid metal, in conjunction with a space requirement which is small in comparison with conventional vessels.

This object is achieved, according to the invention, when the lower portion of the vessel is widened, from the upper portion of the vessel, towards the vessel-bottom, when the diameter of the vessel-bottom running through the axes of the inlet and outlet pipes exceeds the corresponding diameter of the upper portion of the vessel, and exceeds the diameter of the vessel-bottom running perpendicularly thereto, between the inlet pipe and the outlet pipe.

In contrast to treatment vessels of the same type, according to the state of the art (Germal Offenlegungsschrift No. 14 58 874), which have the same circular cross-section over the entire height of the vessel, the vessel-bottom only in the region of the line connecting the inlet and outlet pipes is enlarged in the vessel design according to the invention, so that in spite of an increased cross-section of the inlet and outlet pipes for an increased through the required clearance between the pipes, and with respect to the walls of the vessel, can be maintained, without any danger of increased erosion of the refractory material. Since the vessel is enlarged merely in the lower region, and merely in the direction of the line of the inlet and outlet pipes, the space requirement for the unit as a whole is not significantly changed in particular, the smaller diameter of the vessel-bottom running between the pipes can be designed smaller than the corresponding width of the ladle, so that there is enough space for introducing additives into the molten metal in the ladle. Furthermore the height of the vessel can remain unchanged, this being of particular importance with regard to the manipulations of the vessel which are required during the repair of the refractory material.

For other reasons than that one of the invention a vessel of pear-like form is known (Luxemburg Patent 36 943). In this case the circular crossection of the vessel is continuously reduced from the bottom to the top, in which smallest area a heating element is arranged. Because of this form of the vessel and this position of the heating element far from the bath an intensive heating of the lining in the upper region is achieved and scars (shult) and a soon wear are avoided. As in the known vessels having a circular crossection their diameter corresponds to the diameter of the ladle it is not possible to introduce additives into the molten metal in the ladle when the vessel is positioned above the ladle.

Furthermore the surface of the vessel according to the invention is considerably smaller than with a vessel of the known type designed for the same rate of circulation of the liquid metal. For this reason savings are achieved in respect to the refractory material of the lining and to necessary energy for heating the vessel.

The non-circular cross-section of the vessel-bottom can have various shapes, for example an elliptical shape, a cigar-shape, or a rectangular shape, the elliptical shape being, however, preferred. When a steel-plant ladle with a circular cross-section is placed under the vessel, a vessel of this type, flattened-off on at least one side, offers sufficient free space for carrying out the introduction of additives into the ladle, between the shell of the vessel and the edge of the ladle, without any difficulty.

The lower portion of the vessel is shaped, according to a further development of the invention, in a manner such that its cross-sectional area steadily increases towards the vessel-bottom, so that it is bell-shaped. It is simple to carry out the operation of lining the vessel wall when the lower portion of the vessel has a shape of this kind. In addition, it is possible to widen the cross-section of the lower portion of the vessel in a stepped manner.

DETAILED DESCRIPTION OF THE INVENTION

Figure 1:
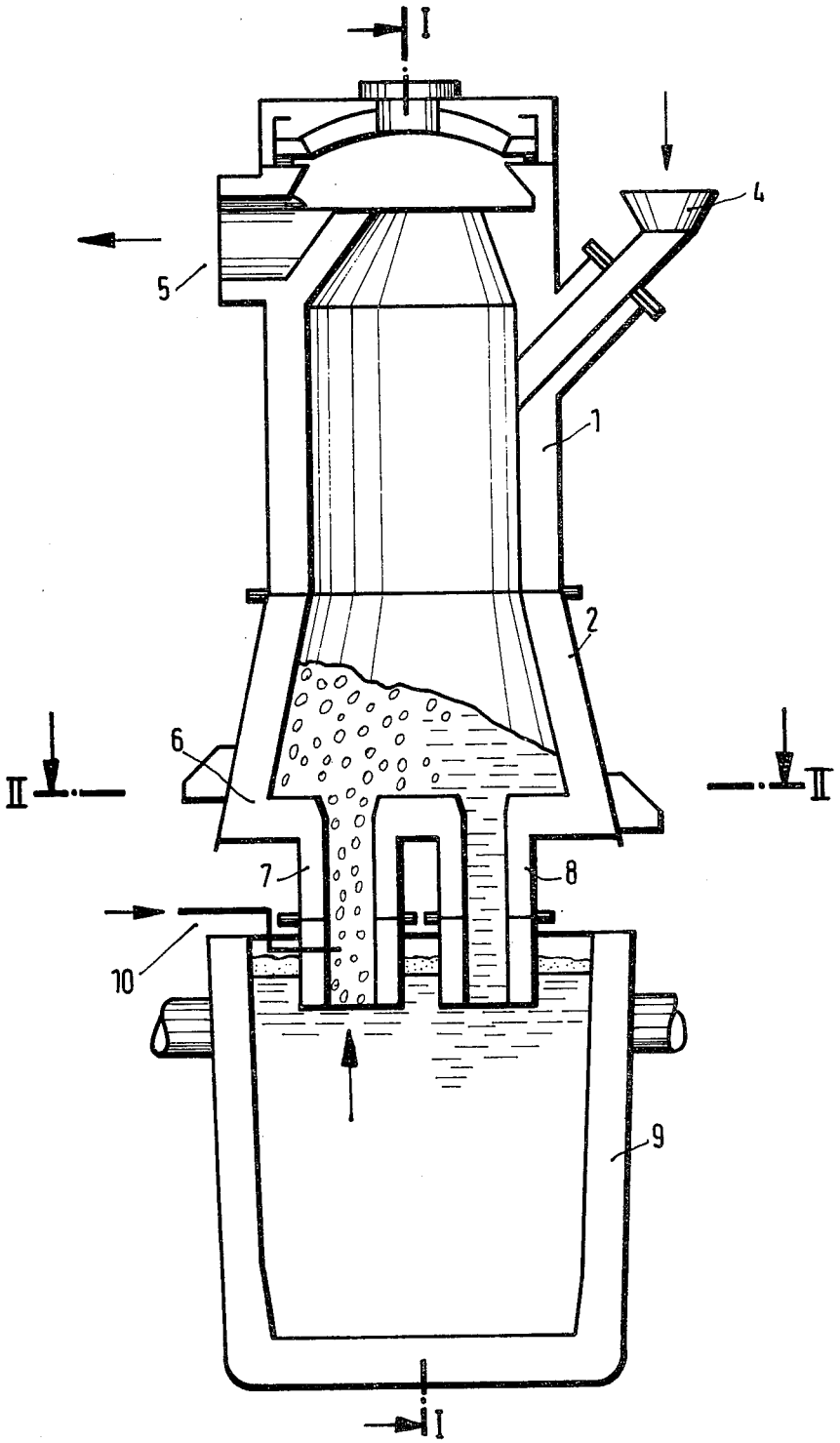
FIG. 1 shows a vessel for the treatment of molten metal, with a ladle located thereunder, in axial longitudinal section through the inlet and outlet pipes of the vessel.

The vessel represented in the drawings comprises an upper vessel-portion 1, which has parallel walls, and, in particular, a circular cross-section, and a lower vessel-portion 2, which is flanged onto the upper portion. The upper portion 1 of the vessel is closed, with respect to the atmosphere, by means of a lid 3. Additives, for example alloying agents, can be introduces via a chute 4, which opens obliquely into the upper portion 1 of the vessel, and in which a lock ist provided in order to close the shaft with respect to the outside. The vessel 1,2 can be placed under reduced pressure by means of a suction device 5, which is connected to the upper portion 1 of the vessel. An inlet pipe 7 and an outlet pipe 8 are located, spatially separated from each other, in the bottom 6 of the vessel, these pipes dipping into the molten metal contained in ladle 9 which is located beneath the vessel 1,2.Gas, for example argon, nitrogen or carbon monoxide is introduced via a line 10, which opens into the inlet pipe 7.

When a reduced pressure prevails in the vessel 1,2, and when the inlet pipe 7 dips into the melt in the ladle 3, the gas, which is rising, as bubbles, in the inlet pipe 7, has the effect of reducing the relative density of the volume within the inlet pipe 7, this volume being made up by molten metal and gas. Since, in the molten metal in the vessel 1,2, the gas bubbles separate out, the molten metal in the outlet pipe 8 no longer contains gas bubbles which reduce the relative density, so that, due to the different weights in the two pipe 7,8, and in conjunction with the reduced pressure in the vessel 1,2, the molten metal is pumped, in a circulation, through the vessel, 1,2 and, at the same time, is treated, in particular degassed.

The appliance thus described up to this point, is known as an appliance for carrying out the Ruhrstahl-Heraeus-circulatory process (German Offenlegungsschrift 1 458 874).

Figure 3:
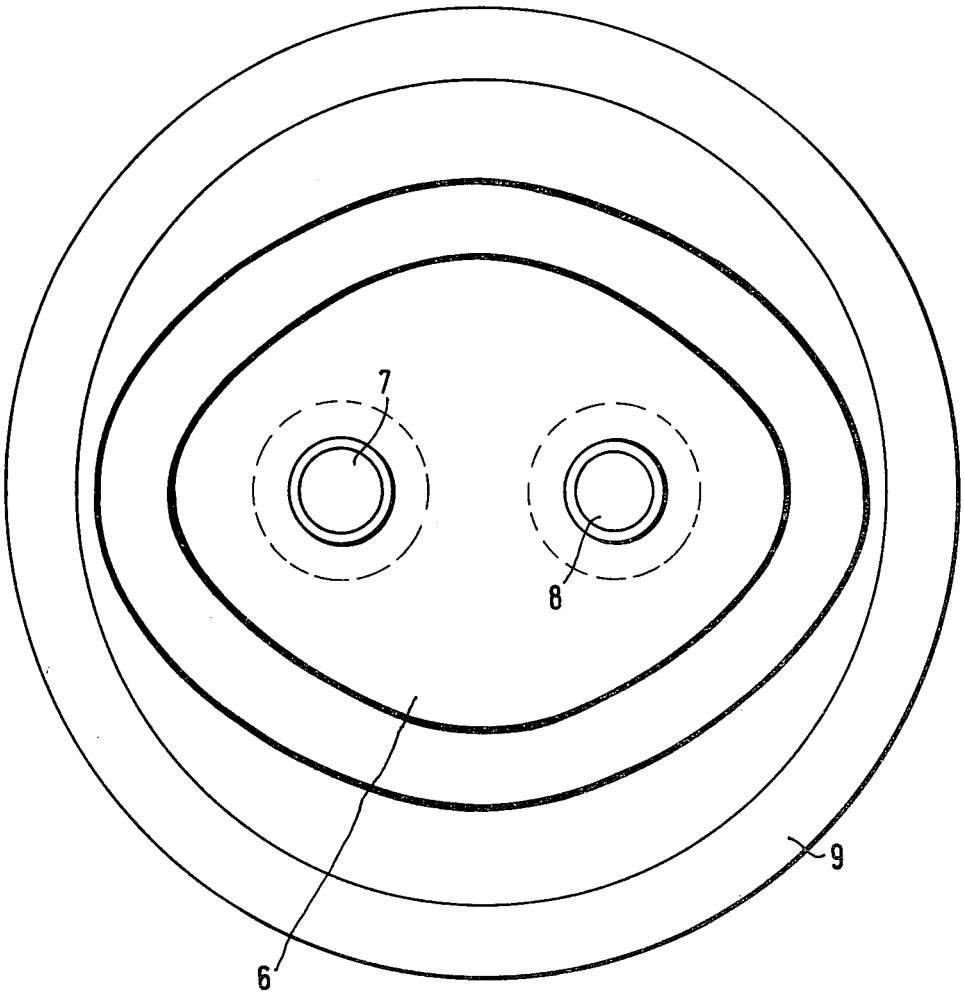
FIG. 3 shows the vessel according to FIG. 1, in cross-section, according to the line II-II of FIG. 1.

In contrast to the state of the art, in the illustrative embodiment of the invention, the vessel-bottom is enlarged, in the direction of the straight line running through the axes of both the inlet and outlet pipes, 7 and 8, and the neighbouring direction so that in spite of larger cross-sections of the inlet and oulet pipe 7,8, sufficient free space between the pipes theirselves and the pipes and the walls is present at least to reduce the danger of erosion effects resulting from the circulating metal. As FIG. 3 shows, the bottom 6 of the vessel 1,2 is elliptical in shape. If the ladle 9 is circular and its diameter corresponds to greater diameter of the elliptical bottom, this elliptical shape leaves sufficient space, on both sides of the line connecting the two pipes, to enable additives, like scrap to be introduced into the melt in the ladle. It is unnecessary, of course, for the vessel-bottom 6 to be flattened off, as in the case of an elliptical shape, on both sides, compared to a circular bottom. It is sufficient for the addition of additives if the flattening is provided only on one side.

Figure 2:
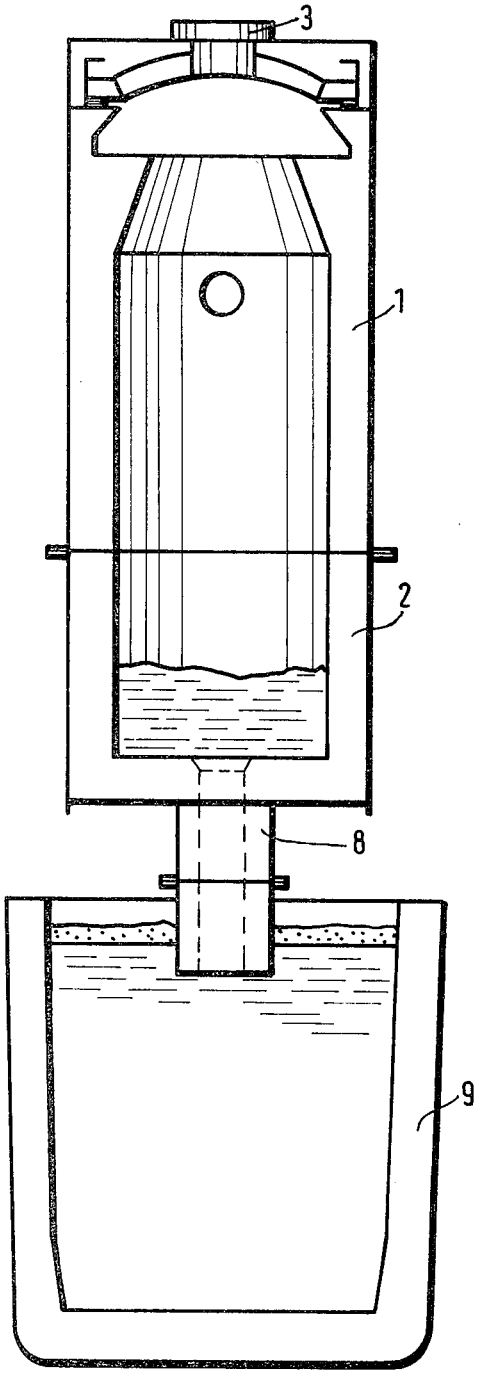
FIG. 2 shows the vessel, according to FIG. 1, in axial longitudinal section between the inlet and outlet pipes, according to the line I-I in FIG. 1.

As can be seen from FIGS. 1 and 2, the side walls in the region of the longitudinal axis of the elliptical bottom 6 merge obliquely into the upper portion of the vessel, while the walls in the region of that axis of the ellipse which is perpendicular to the longitudinal axis run vertically. In order to have even more freedom of movement, one of these walls can even be allowed to run at an angle counter to the walls at the ends of the major axis of the ellipse. This would lead to an indentation in the vessel-bottom 6, located at one end of the minor axis of the ellipse.

The vessel-bottom 6, which is flattened off compared to a circular shape, and the bell-shaped lower portion of the vessel, which is appropriately located above the vessel-bottom, enables the pipes 7,8, which have increased cross-sections, to be arranged with a large clearance with respect to each other, and with an adequate clearance from the walls of the vessel 1,2, and with sufficient free space, relative to the edge of the ladle 9 for introducing additives, accompanied by a small volume of the lower portion 2 of the vessel, and a small surface area.

We claim:

1. A vessel for the continuous treatment of molten metals under reduced pressure, according the circulation process, especially for degassing steel melts, this vessel being provided, in its bottom, with an inlet pipe which dips into the molten metal, and an outlet pipe for the molten metal which has been treated, this outlet pipe being located so that it is spatially separated from the inlet pipe and, in particular, dipping into the molten metal, wherein the lower portion (2) of the vessel is widened, from the upper portion (1) of the vessel, towards the vessel-bottom (6), in a manner such that the diameter of the vessel-bottom (6) running through the axes of the inlet and outlet pipes (7 and 8) exceeds the corresponding diameter of the upper portion (1) of the vessel, and exceeds the diameter of the vessel-bottom (6) running perpendicularly thereto, between the inlet pipe (7) and the outlet pipe (8) which is not greater than the corresponding diameter of the upper portion (1) of the vessel.

2. The vessel as claimed in claim 1, wherein the vessel-bottom (6) is approximately elliptical in shape.

3. The vessel as claimed in claim 1, wherein the widened lower portion (2) of the vessel is bell-shaped.

4. A vessel as claimed in claim 1, wherein the vessel-bottom only in the region of the line connecting the axis of the inlet and outlet pipes is widened towards the vessel-bottom.

* * * * *